US008689875B2

(12) United States Patent
Dudley et al.

(10) Patent No.: US 8,689,875 B2
(45) Date of Patent: Apr. 8, 2014

(54) FORMATION TREATMENT USING ELECTROMAGNETIC RADIATION

(75) Inventors: James H. Dudley, Spring, TX (US); Khanh T. Ma, Bellaire, TX (US); Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 216 days.

(21) Appl. No.: 12/990,512

(22) PCT Filed: May 19, 2009

(86) PCT No.: PCT/US2009/044536

§ 371 (c)(1),
(2), (4) Date: Dec. 9, 2010

(87) PCT Pub. No.: WO2009/151891

PCT Pub. Date: Dec. 17, 2009

(65) Prior Publication Data

US 2011/0108277 A1 May 12, 2011

Related U.S. Application Data

(60) Provisional application No. 61/054,459, filed on May 19, 2008.

(51) Int. Cl.
*E21B 43/26* (2006.01)

(52) U.S. Cl.
USPC ..... 166/308.1; 166/280.1; 166/281; 166/66.5

(58) Field of Classification Search
USPC ..... 166/308.1, 250.1
See application file for complete search history.

(56) References Cited

U.S. PATENT DOCUMENTS

| | | | | |
|---|---|---|---|---|
| 2,757,738 | A * | 8/1956 | Ritchey | 166/248 |
| 3,602,309 | A * | 8/1971 | Hill | 166/299 |
| 4,904,942 | A * | 2/1990 | Thompson | 324/323 |
| 6,426,917 | B1 * | 7/2002 | Tabanou et al. | 367/82 |
| 7,082,993 | B2 | 8/2006 | Ayoub et al. | |
| 7,134,492 | B2 * | 11/2006 | Willberg et al. | 166/250.1 |
| 7,804,296 | B2 * | 9/2010 | Flaum et al. | 324/303 |
| 2006/0102345 | A1 * | 5/2006 | McCarthy et al. | 166/250.1 |
| 2007/0204995 | A1 * | 9/2007 | Hofman et al. | 166/308.1 |
| 2007/0256830 | A1 | 11/2007 | Entov et al. | |
| 2008/0073079 | A1 * | 3/2008 | Tranquilla et al. | 166/270.1 |
| 2008/0149329 | A1 * | 6/2008 | Cooper et al. | 166/250.01 |
| 2008/0149335 | A1 * | 6/2008 | Lee | 166/285 |

OTHER PUBLICATIONS

PCT/US2009/044536 International Search Report and Written Opinion dated Jan. 21, 2010, (10 p.).

* cited by examiner

*Primary Examiner* — Angela M DiTrani
*Assistant Examiner* — Silvana Runyan
(74) *Attorney, Agent, or Firm* — Conley Rose, P.C.

(57) ABSTRACT

Treating a subterranean formation includes injecting a magnetically permeable material into the formation and energizing the magnetically permeable material using electromagnetic radiation. The magnetically permeable material reacts to the electromagnetic radiation by producing heat. In some embodiments, a fracturing fluid is made magnetically permeable, injected into the formation to fracture the formation, and heated in response to electromagnetic radiation applied to the magnetically permeable material. In some embodiments, electromagnetically heated material is caused to explode. In some embodiments, the magnetically permeable material is tracked or monitored for fluid or fracture propagation. A system includes a fluid treatment tool disposed on a tubing string for injecting magnetically permeable material and an electromagnetic wave generator disposed on the tubing string proximate the fluid treatment apparatus for applying electromagnetic radiation to the magnetically permeable material.

21 Claims, 6 Drawing Sheets

FORMATION TREATMENT USING ELECTROMAGNETIC RADIATION

CROSS-REFERENCE TO RELATED APPLICATIONS

The present application claims priority to U.S. Provisional Application Ser. No. 61/054,459 filed May 19, 2008, entitled "Formation Fracturing Using Electromagnetic Radiation".

This application is a 35 U.S.C. §371 national stage application of PCT/US2009/044536 filed May 19, 2009, which claims the benefit of U.S. Provisional Patent Application No. 61/054,459 filed May 19, 2008, both of which are incorporated herein by reference in their entireties for all purposes.

BACKGROUND

When drilling a wellbore in the earth, a drilling fluid may be pumped down a drill string and through a drill bit attached to the end of the drill string. The drilling fluid may also flow through a bottom hole assembly ("BH2A") located in the drill string above the bit. The BHA may house any number of tools or sensors for performing operations while the drill string is in the wellbore. The drilling fluid is generally used for lubrication and cooling of drill bit cutting surfaces while drilling, transportation of "cuttings" (pieces of formation dislodged by the cutting action of the teeth on a drill bit) to the surface, controlling formation pressure to prevent blowouts, maintaining well stability, suspending solids in the well, minimizing fluid loss into and stabilizing the formation through which the well is being drilled, fracturing the formation in the vicinity of the well, and displacing the fluid within the well with another fluid. When drilling is completed, the wellbore remains filled with the drilling fluid.

After drilling, casing is often placed in the wellbore to facilitate the production of oil and gas from the formation. The casing is a string of pipes that extends down the wellbore, through which the oil and gas will eventually be extracted.

The region between the casing and the wellbore itself is known as the casing annulus. To fill up the casing annulus and secure the casing in place, the casing is usually "cemented" in the wellbore. Before and even after casing is installed, the well may require wellbore treatment that is referred to as stimulation. Stimulation involves pumping stimulation fluids such as fracturing fluids, acid, cleaning chemicals, and/or proppant laden fluids into the formation to improve wellbore production. The stimulation fluids are pumped through the casing and then into the wellbore. If the casing is installed and more than one zone of interest of the formation is treated, tools may be run into the casing to isolate fluid flow at each zone.

In the case of hydraulic fracturing using fracturing fluids, the fluids are pumped at high pressure and rate into the reservoir interval to be treated, causing a vertical fracture to open. Proppant, such as grains of sand of a particular size, is mixed with the treatment fluid to keep the fracture open when the treatment is complete, thereby creating a plane of high-permeability sand through which fluids can flow.

Instead of stimulating the formation after installing casing, the well operator may choose to stimulate an uncased portion of a wellbore. To do so, the operator may run a liner extending from the surface into the uncased section of the wellbore with inflatable element packers to isolate the portions of the wellbore. Multiple packers allow the operator to isolate segments of the uncased portion of the wellbore so that each segment may be individually treated to concentrate and control fluid treatment along the wellbore. Generally, the packers are run for a wellbore treatment, but must be moved after each treatment if it is desired to isolate other segments of the well for treatment.

The tubing work string, which conveys the treatment fluid, may include a fracturing or jetting tool for delivering the treatment fluid to the cased or uncased borehole. Alternatively, the tubing string can include ports or openings for the fluid to pass into the wellbore and ultimately to the casing or the formation. Where more concentrated fluid treatment is desired in one position along the wellbore, a small number of larger ports may be used. Where it is desired to distribute treatment fluids over a greater area, a perforated tubing string may be used having a plurality of spaced apart perforations through its wall. The perforations can be distributed along the length of the tube or only at selected segments. The open area of each perforation can be pre-selected to control the volume of fluid passing from the tube during use.

While the introduction of stimulation fluids to the formation can increase formation fluid flow therein and production therefrom, such as by fracturing the formation to create additional fluid flow paths, further fluid flow enhancement will optimize production. Well stimulation deficiencies are overcome by the principles taught herein.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
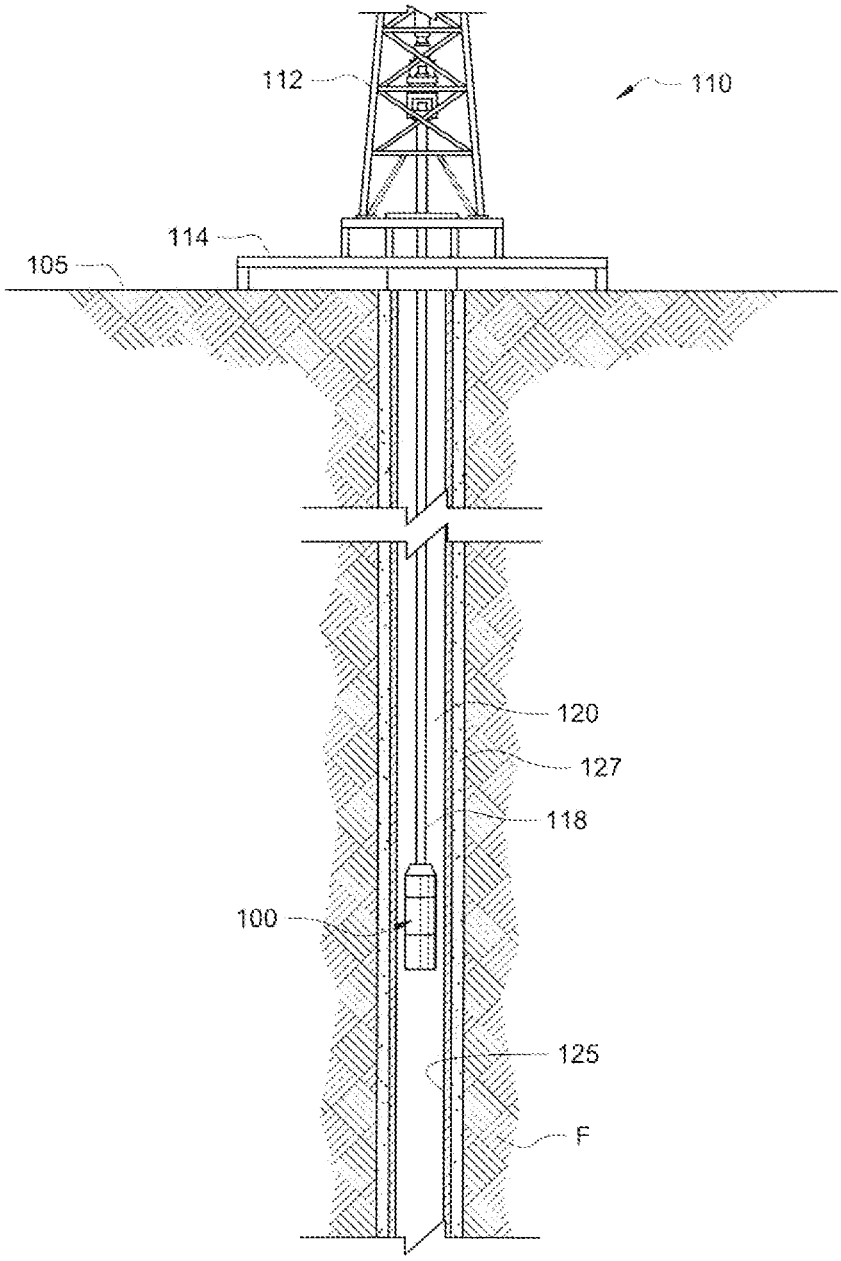
FIG. 1 is a schematic, partial cross-section view of a fluid stimulation tool in an operating environment.

In the drawings and description that follows, like parts are marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

FIG. 1 schematically depicts an exemplary operating environment for a fluid treatment or stimulation tool 100. The tool 100 may be a pressurizing or hydrojetting tool. A drilling rig 110 is positioned on the earth's surface 105 and extends over and around a well bore 120 that penetrates a subterranean formation F for the purpose of recovering hydrocarbons. The well bore 120 may drilled into the subterranean formation F using conventional (or future) drilling techniques and may extend substantially vertically away from the surface 105 or may deviate at any angle from the surface 105. In some instances, all or portions of the well bore 120 may be vertical, deviated, horizontal, and/or curved.

At least the upper portion of the well bore 120 may be lined with casing 125 that is cemented 127 into position against the formation F in a conventional manner. Alternatively, the operating environment for the fluid stimulation tool 100 includes an uncased well bore 120. The drilling rig 110 includes a derrick 112 with a rig floor 114 through which a work string 118, such as a cable, wireline, E-line, Z-line, jointed pipe, coiled tubing, or casing or liner string (should the well bore 120 be uncased), for example, extends downwardly from the drilling rig 110 into the well bore 120. The work string 118 suspends a representative downhole fluid stimulation tool 100 to a predetermined depth within the well bore 120 to perform a specific operation, such as perforating the casing 125, expanding a fluid path therethrough, or fracturing the formation F. The drilling rig 110 is conventional and therefore includes a motor driven winch and other associated equipment for extending the work string 118 into the well bore 120 to position the fluid stimulation tool 100 at the desired depth.

While the exemplary operating environment depicted in FIG. 1 refers to a stationary drilling rig 110 for lowering and setting the fluid stimulation tool 100 within a land-based well bore 120, it is noted that mobile workover rigs, well servicing units, such as slick lines and e-lines, and the like, could also be used to lower the tool 100 into the well bore 120. It should be understood that the fluid stimulation tool 100 may also be used in other operational environments, such as within an offshore well bore or a deviated or horizontal well bore. The exemplary tools and operating environment of FIG. 1, and FIG. 2 below, can be used in conjunction with the various embodiments described herein.

Figure 2:
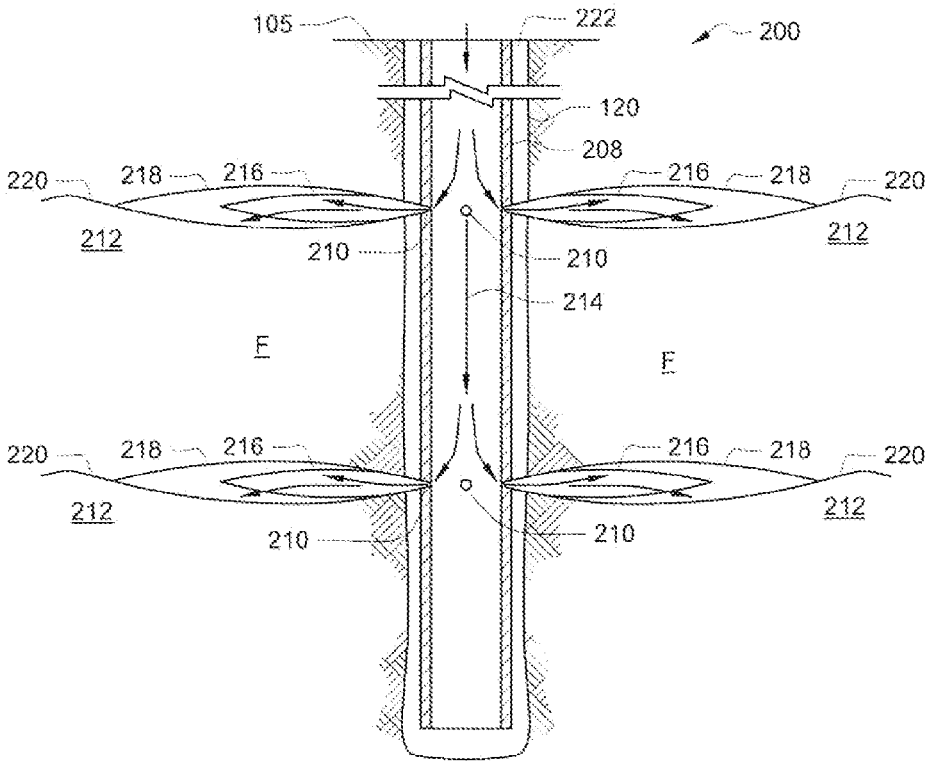
FIG. 2 is a cross-section view of a fluid pressurizing well stimulation assembly.

Referring now to FIG. 2, in another embodiment, the schematic fluid jetting tool 100 comprises an exemplary well completion assembly 200. The well completion assembly 200 is disposed in the well bore 120 coupled to the surface 105 and extending down through the subterranean formation F. The completion assembly 200 includes a conduit 208 extending through at least a portion of the well bore 120. The conduit 208 may or may not be cemented to the subterranean formation F. In some embodiments, the conduit 208 is a portion of a casing string coupled to the surface 105 by an upper casing string, represented schematically by work string 118 in FIG. 1. Cement is flowed through an annulus 222 to attach the casing string to the well bore 120. In some embodiments, the conduit 208 may be a liner that is coupled to a previous casing string. When uncemented, the conduit 208 may contain one or more permeable liners, or it may be a solid liner. As used herein, the term "permeable liner" includes, but is not limited to, screens, slots and preperforations. Those of ordinary skill in the art, with the benefit of this disclosure, will recognize whether the conduit 208 should be cemented or uncemented and whether conduit 208 should contain one or more permeable liners.

The conduit 208 includes one or more pressurized fluid apertures 210. Fluid apertures 210 may be any size, for example, 0.75 inches in diameter. In some embodiments, the fluid apertures 210 are jet forming nozzles, wherein the diameter of the jet forming nozzles are reduced, for example, to 0.25 inches. The inclusion of jet forming nozzles 210 in the well completion assembly 200 adapts the assembly 200 for use in hydrojetting. In some embodiments, the fluid jet forming nozzles 210 may be longitudinally spaced along the conduit 208 such that when the conduit 208 is inserted into the well bore 120, the fluid jet forming nozzles 210 will be adjacent to a local area of interest, e.g., zones 212 in the subterranean formation F. As used herein, the term "zone" simply refers to a portion of the formation and does not imply a particular geological strata or composition. Conduit 208 may have any number of fluid jet forming nozzles, configured in a variety of combinations along and around the conduit 208.

Once the well bore 120 has been drilled and, if deemed necessary, cased, a fluid 214 may be pumped into the conduit 208 and through the fluid jet forming nozzles 210 to form fluid jets 216. In one embodiment, the fluid 214 is pumped through the fluid jet forming nozzles 210 at a velocity sufficient for the fluid jets 216 to form perforation tunnels 218. In one embodiment, after the perforation tunnels 218 are formed, the fluid 214 is pumped into the conduit 208 and through the fluid jet forming nozzles 210 at a pressure sufficient to form cracks or fractures 220 along the perforation tunnels 218.

The composition of fluid 214 may be changed to enhance properties desirous for a given function, i.e., the composition of fluid 214 used during fracturing may be different than that used during perforating. In certain embodiments, an acidizing fluid may be injected into the formation F through the conduit 208 after the perforation tunnels 218 have been created, and shortly before (or during) the initiation of the cracks or fractures 220. The acidizing fluid may etch the formation F along the cracks or fractures 220, thereby widening them. In certain embodiments, the acidizing fluid may dissolve fines, which further may facilitate flow into the cracks or fractures 220. In another embodiment, a proppant may be included in the fluid 214 being flowed into the cracks or fractures 220, which proppant may prevent subsequent closure of the cracks or fractures 220. The proppant may be fine or coarse. In yet another embodiment, the fluid 214 includes other erosive substances, such as sand, to form a slurry. Complete well treatment processes including a variety of fluids and fluid particulates may be understood with reference to Halliburton Energy Service's SURGIFRAC® and COBRAMAX®. The fluid component embodiments described above may be used in various combinations with each other and with the other embodiments disclosed herein.

Disclosed is a method and system for stimulating a formation using electromagnetic radiation. In at least some of the embodiments, in a formation that has been or is being stimulated or fractured, the flow of fluids is increased by heating the formation and the fluids via the coupling of electromagnetic radiation to materials that have been injected or "fracced" into the formation. In certain embodiments, an injectable or fracturing fluid is made magnetically permeable. The magnetically permeable fluid is injected into the formation, or in the case of fracturing operation, the fluid is injected with such pressure so as to fracture or split the formation. From the borehole, such as via the work string or the casing, electromagnetic radiation is directed to the magnetically permeable fluids. The magnetically permeable fluids are heated in response to the electromagnetic radiation. The produced heat also heats the surrounding formation and formation fluids. The heat reduces the viscosity of the formation fluids, thereby increasing the flow of the formation fluids. In at least some of the embodiments, a means is provided for monitoring the progression of stimulating or fraccing fluids into a formation.

In at least one embodiment, the fluidic material that is injected or fracced into the formation is magnetically permeable. In some embodiments, the fluidic material is made magnetically permeable by using a ferrofluid. In other embodiments, the fluidic material is made magnetically permeable by suspending magnetically permeable balls in the fluid. In certain embodiments, the fluidic material is made magnetically permeable by suspending magnetized balls in the fluid. In exemplary embodiments, the ball size is approximately 1 micron.

In at least one embodiment, a system is provided for fraccing magnetically permeable materials from the well bore into the formation, and to heat the formation and formation fluids by also sending from the well bore electromagnetic waves to the magnetically permeable materials. The reaction between the electromagnetic waves and the magnetically permeable materials produces heat that reduces viscosity and improves the fluid flow of formation fluids. In further embodiments, heating the fracced fluids and formation fluids causes reactions that can be used to locate the fracture.

In at least one embodiment, a system is provided for fraccing explosive balls into the formation. Application of heat in accordance with the principles herein causes the balls to explode to further increase the efficiency of the fraccing operation.

In at least one embodiment, a system is provided for fraccing chemicals into the formation. Application of heat in accordance with the principles herein causes the chemicals to release to deteriorate the formation and further increase the efficiency of the fraccing operation. For example, an acid may be released by heat into the formation to deteriorate the formation.

In at least one embodiment, a fluid is enhanced with a magnetically permeable material to form a magnetically permeable fluidic material. The magnetically permeable fluidic material is injected or fracced into a subterranean formation during stimulation or fracturing operations. In some embodiments, the magnetically permeable material is magnetized.

In some embodiments, the magnetically permeable material includes a ferrofluid. In other embodiments, the injectable fluid contains magnetically permeable objects or target particles. The objects or target particles may include magnetically permeable balls or magnetically permeable ellipsoids. The term "ball" or "balls" may refer to spheres, spheroids, ellipsoids, or any of these with a cavity. In some embodiments, the target objects are nanoparticles. In still further embodiments, the injectable fluid contains magnetized objects. In certain embodiments, the objects may be magnetized as they are being injected into the formation so as to avoid clumping. In some embodiments, the injectable magnetically permeable material comprises primarily the balls or magnetically permeable ellipsoids. In exemplary embodiments, the magnetically permeable objects or target particles comprise any ferromagnetic material with a Curie temperature above, or alternatively well above, the temperature to which the formation is to be heated for increased formation fluid flow.

Figure 3:
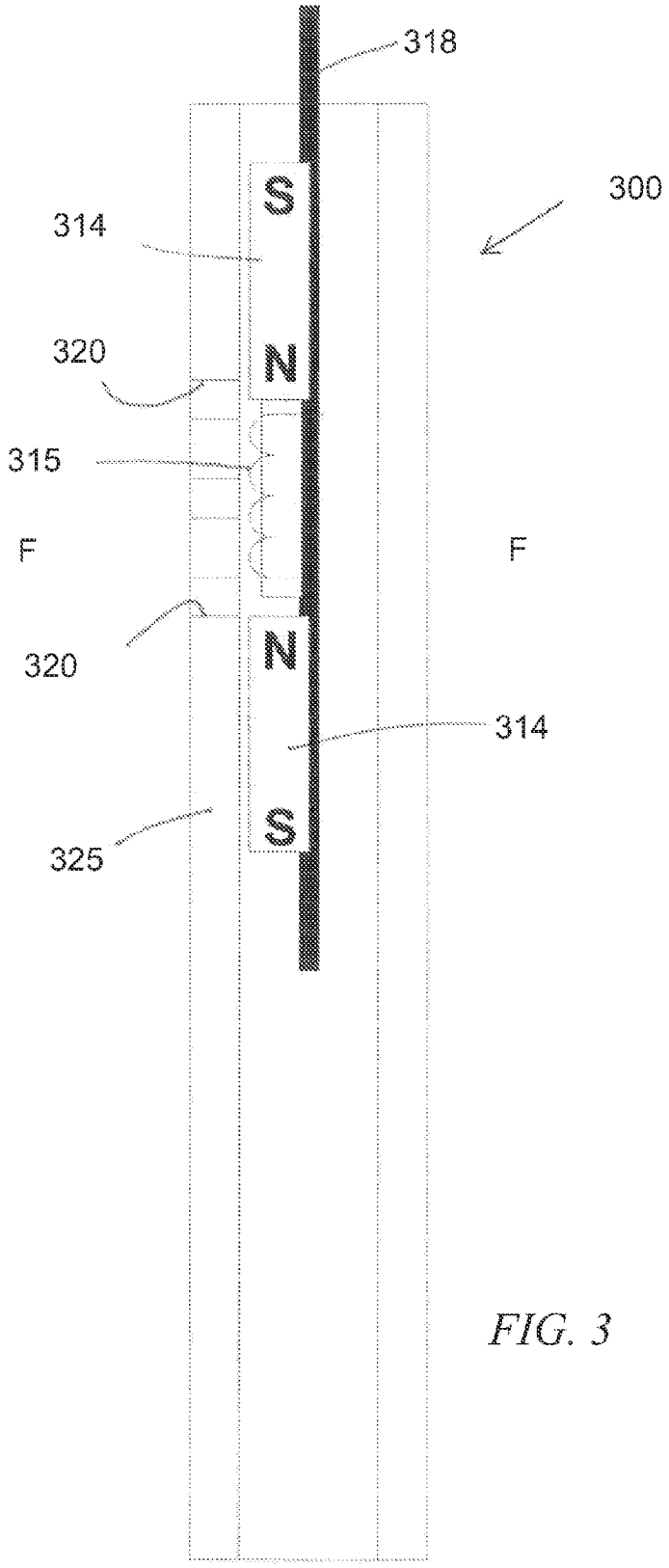
FIG. 3 is a cross-section of an apparatus for generating electromagnetic radiation in accordance with at least one of the embodiments.

Next, a low frequency electromagnetic wave generator disposed within the borehole, for example on a workstring or drillstring, radiates or emits energy toward the magnetically permeable target material. Referring to FIG. 3, an apparatus 300 is coupled to a work string 318 and may be used to generate electromagnetic radiation directed into the formation F. In some embodiments, the apparatus 300 is disposed proximate the fluid treatment tools described herein. The apparatus 300 is disposed adjacent perforations 320 in a casing 325. The apparatus 300 may include one or more electromagnets 314 and an electrical coil or solenoid 315. In embodiments with a plurality of electromagnets, the electromagnets are driven so as to focus the time varying magnetic field onto the fracture in such a way as to launch surface waves. The apparatus 300 is powered and radiates electromagnetic waves which then couple with the magnetically permeable target material already disposed in the formation F, such as in the fluid 214 disposed in the perforation tunnels 218 in FIG. 2. The electromagnetic energy is converted to heat energy in the magnetically permeable materials.

In some embodiments, heat is generated through hysteretic cycling the magnetically permeable materials. The electromagnetic waves are converted to heat energy as a result of cycling of the magnetic material around its permeability loop, wherein heat energy is created as the integral of the product of the electric field intensity and the magnetic flux density. In other embodiments, heat is generated through viscous drag of the magnetically permeable balls that are displaced by an oscillating magnetic field. At low frequencies, the oscillating magnetic field can induce flipping and spin of the magnetic particles in the magnetically permeable target material that emit heat into the formation via viscous drag.

Figure 4:
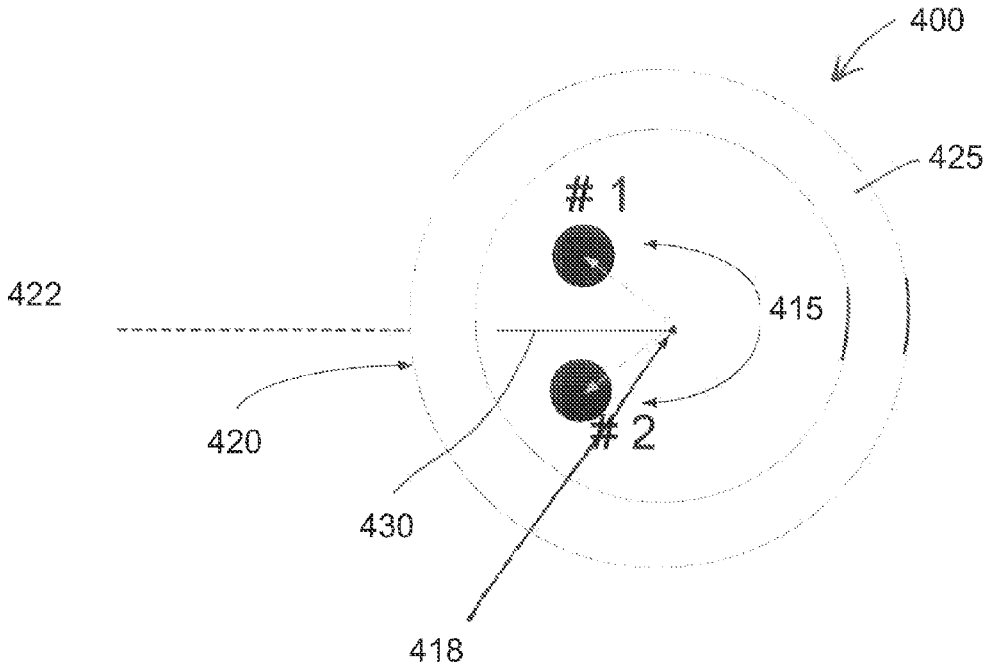
FIG. 4 is a cross section at a perforation showing a schematic of an apparatus for generating electromagnetic radiation in accordance with another embodiment.

Referring to FIG. 4, a radial cross-section of a borehole including a casing 425 is shown. The casing includes a perforation 420 resulting from a stimulation or fracturing operation. An electromagnetic wave generating apparatus 400, similar to the apparatus 300, is disposed in the casing 420 adjacent the perforation 420. The cross-sectional view shows an embodiment including two solenoids 415, although other embodiments may include more solenoids. Included, but not shown, are bucking magnets above and below the solenoids 415, similar to the permanent magnets 314 shown in FIG. 3. The purpose of the bucking magnets is to polarize the casing to drive its AC permeability close to that of free space. Such a configuration of the casing due to the solenoids and the bucking magnets will further the desirable emission of electromagnetic waves from the wave generator apparatus 300, 400 into the formation.

Still referring to FIG. 4, the axis 418 along the borehole will be defined as the z-axis and will be positive when directed downward. Polar coordinates are used with the center of the borehole 418 as the radial reference and a line 430 from the center of the borehole 418 through the center of the perforation 420 as the zero-reference for the polar angle. The two solenoids 415 may be oriented along the z-axis, and may be represented by ideal dipole fields of certain frequencies and relative phases. In some embodiments, the relative phase between the dipoles may be a function of time. In some embodiments, the frequencies may be a function of time. In some embodiments, when sensing the depth of fracturing, the solenoids can be pulsed. In some embodiments, the dipoles need not be on opposite sides of the plane of initiation 422 of a fracture.

In some embodiments, the electromagnetic field can be put into the formation F by magnetically polarizing the casing into saturation with a permanent magnet or a DC electromagnet, in accordance with the embodiment described herein. Then, the oscillating the magnetic field is superimposed on the casing.

Figure 5:
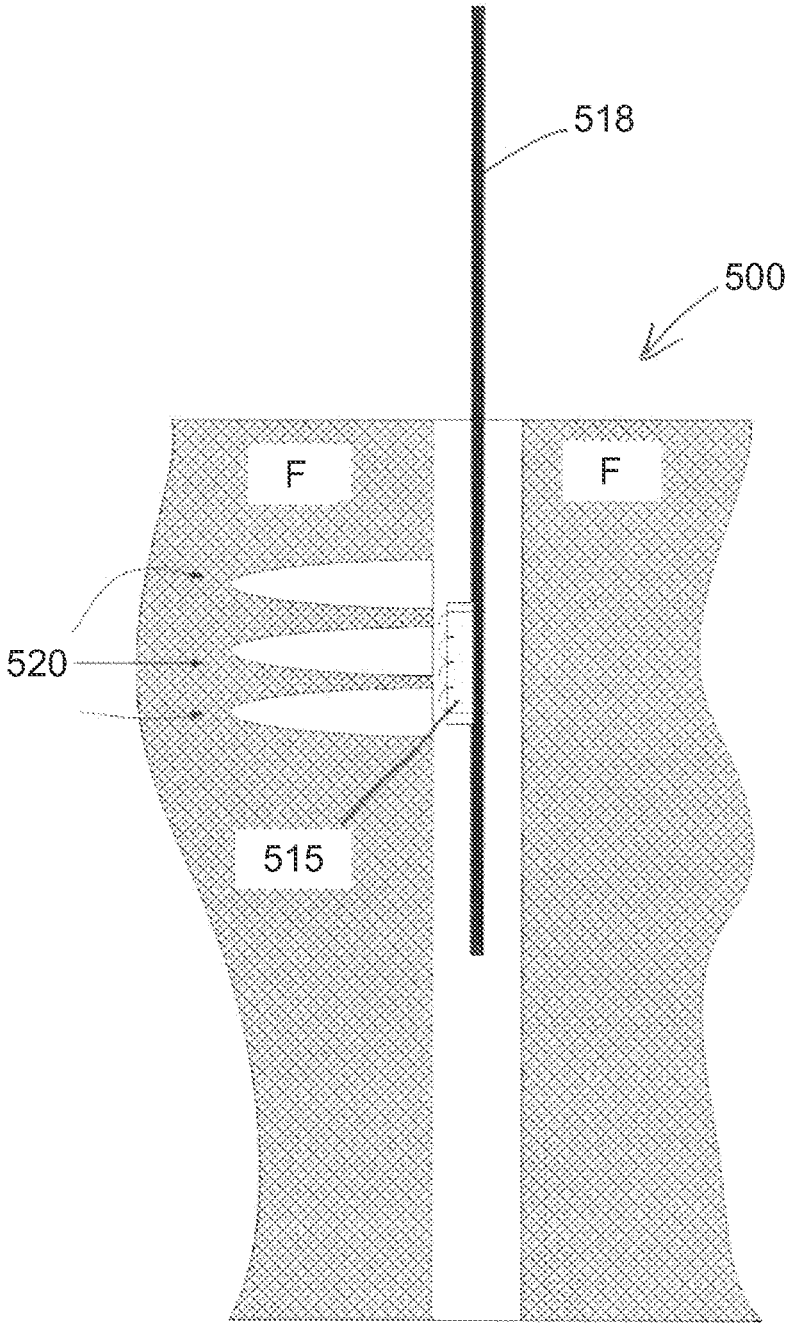
FIG. 5 is a cross-section of an apparatus for generating electromagnetic radiation in accordance with a further embodiment.

In other embodiments, and with reference to FIG. 5, an apparatus 500 is conveyed by a work string 518 into an open, uncased borehole. The apparatus 500 includes a solenoid 515 or series of solenoids, and the permanent magnets are removed. The apparatus 500 and solenoid 515 are powered to direct electromagnetic waves toward the formation F and the magnetically permeable materials deposited therein, such as in fractures 520. Thus, in some embodiments, the solenoid dipole fields can be disposed along the drill string or other work string 518, or along the tool 500 axis.

Since a treatment fracture in the formation may be on the order of 1 mm wide at its inception, several meters high and tens to hundreds of meters long, the presence of the fracture can be conducive to propagation of surface electromagnetic waves. Even when the fraccing fluid is electrically insulating, the high relative permeability of the fluid created by the introduction of magnetically permeable materials can result in the speed of electromagnetic waves in the fluid being significantly less than the speed of electromagnetic waves in the surrounding formation. Such waves can be induced by placing an oscillating magnetic or electromagnetic dipole, as described herein, in an opening in the casing that has been provided to allow fraccing of the formation. The dipole axis is aligned with the long-axis of the opening in the casing. Alternatively, the openings are made directly in the uncased formation, as previously described, and the dipoles are disposed along the drill string, work string or tool axis.

In other embodiments, where the injectable fluids include high conductivity compared to the conductivity of the surrounding formation, such circumstances can be conducive to the launch of a surface wave.

By directing the magnetic field as described herein, the field can be made to skirt along the surface of the fracture. This is explained in terms of Maxwell's equations as follows:

$$v \cdot \overline{B} = 0$$

$$v \cdot \overline{H} = \overline{J_s} + \frac{\partial}{\partial t}\overline{D}$$

where $\vec{B}$ is the magnetic flux density, $\vec{H}$ is the magnetic field intensity, $\vec{J_s}$ is a source current term, and $\vec{D}$ is the displacement vector.

There will be no source terms in the region of interest, and the frequency are such that the time derivative of the displacement vector can be neglected. Therefore:

$$v - \vec{H} = 0$$

In words, the tangential component of $\vec{H}$ is conserved across a boundary while the normal component of $\vec{B}$ is conserved across the same boundary.

These boundary conditions imply that the larger the magnetic permeability of the fluid in the fracture can be made relative to the magnetic permeability of the formation, which is typically extremely close to the magnetic permeability of free space (4 p*10−7 H/m), the more the magnetic field will be aligned with the fracture plane itself.

At higher frequencies, where induction or propagation is considered, the resultant field is a surface wave. Energy propagated via a surface wave can interact directly with magnetic material along the fracture plane, deposited according to the principles described herein, causing it to heat up.

In some embodiments, when target objects are used as the magnetically permeable material, the objects may include a cavity into which a small amount of explosive charge is placed. The explosive charge is configured to detonate at a pre-defined temperature and pressure, and may be selected from any suitable material for downhole explosions. In further embodiments, acoustic waves emitted by such explosions will help promote the fraccing process and also provide acoustic emissions from which the propagation of the fraccing material can be monitored and the progress of the fracturing operation can otherwise be tracked.

In additional embodiments, the locations of the injected target objects or the fractures can be determined by the scattered return of magnetic or electromagnetic signals, and from a single wellbore. In one embodiment, a transmitter is powered to transmit a substantially constant frequency into the formation while monitoring for scattered electromagnetic signals at the same frequency using a separate antenna. The progression of fraccing is monitored by canceling a portion of the direct signal, and then tracking the change with time of the amplitude and phase of the received signal, where the phase is referenced to the transmitter. In a second embodiment, heating of the formation is periodically terminated and the electromagnetic wave signal for heating is replaced by an electromagnetic pulse. A receiver with source cancellation capabilities similar to those described with reference to the first embodiment receives echoes of the pulse. The times of the echoes, coupled with knowledge of the electrical properties of the formation and the electromagnetic properties of the stimulation fluid or the stimulation fluid with suspended magnetically permeable materials is used to determine the distance from which the echo was generated, and hence provide a lower limit to the depth of penetration of the fracturing process. In a third embodiment, a technique similar to nuclear magnetic resonance (NMR) echo measurements can also be used to generate a pulse and listen for a return. This is similar to the technique in the second embodiment above, but in addition to echoes, the exponential decay of the echoes is analyzed indicating, in those cases where balls are used as the magnetically permeable target objects, how much viscous drag is acting on the balls.

Figure 6:
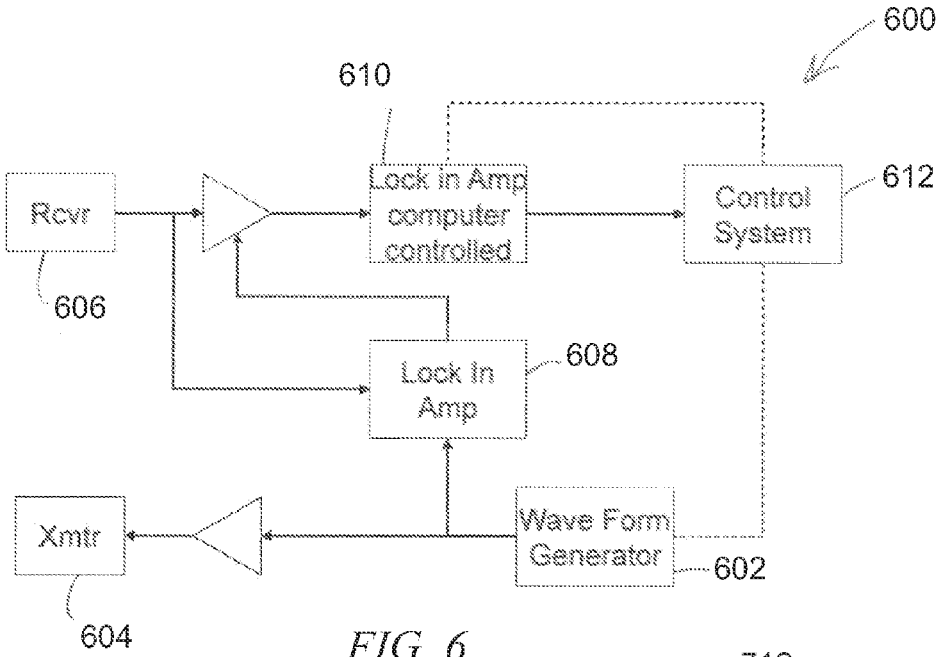
FIG. 6 is an example system for monitoring the position of magnetically permeable fluids in a formation.

In some embodiments, monitoring the progression of the stimulation or fracturing process is achieved. In at least one embodiment shown in FIG. 6, a monitoring system 600 is provided that can be embedded in the various embodiments described above. System 600 includes a reference that is provided from a signal that is injected into the formation from a wave form generator 602 and a transmitter 604 in accordance with the principles herein. In some embodiments, the signal is a sine wave at a fixed frequency and phase. The reference is provided as the reference signal to a lock-in amplifier 608. A receiver 606 is also connected to the lock-in amplifier 608. The lock-in amplifier 608 is coupled to a computer control 612 in some embodiments. The computer control 612 establishes the amplitude and phase of that component of the transmitted signal that interferes with the received signal. The output from the lock-in amplifier 608 is input into a differencing amplifier along with the output of the receiver 606 so as to subtract out the direct interference from the transmitter in the receiver. The output of the differencing amplifier is then connected to a separate lock-in amplifier 610 that is computer controlled. The output amplitude of the lock-in amplifier 610 is determined as a function of phase. Peaks in an amplitude/phase plot correspond to reflections from magnetic inhomogeneities in the fracturing fluid and thus trace the progression of the fracturing. The larger the phase, the further out the fraccing process has progressed.

Figure 7:
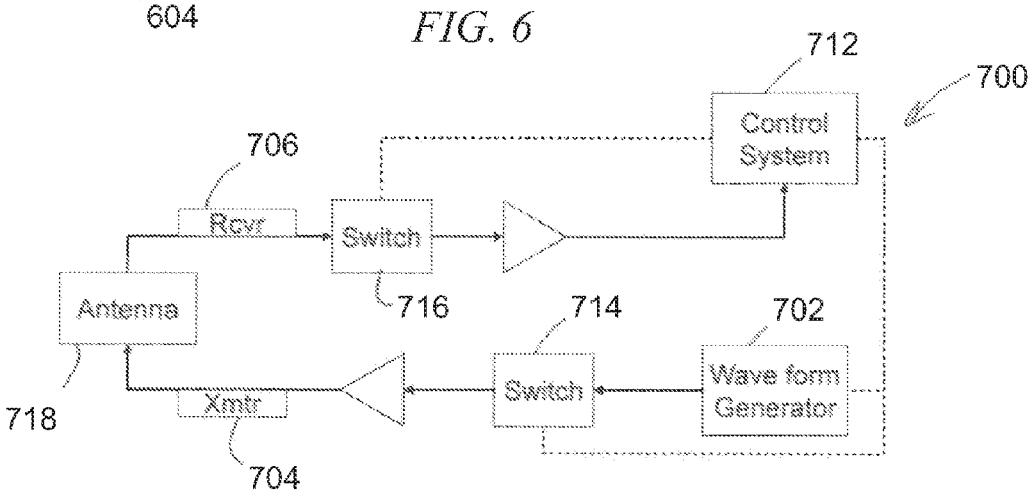
FIG. 7 is another example system for monitoring the position of magnetically permeable fluids in a formation.

In an alternative embodiment shown in FIG. 7, a system 700 includes a waveform generator 702 connected to a transmitter 704. In normal operation, the waveform generator 702 puts out a high power single frequency sine wave. However, when it is desired to determine how far the fraccing operation has penetrated the formation, the waveform generator 702 is switched by a switch 714 to a pulse generating mode. Under computer control 712, a pulse is initiated, and upon termination of the pulse, a transmitting antenna 718 is disconnected from a power amplifier, snubbed, and a receiving antenna is switched by a switch 716 into a signal amplifier. In some embodiments, the receiving antenna is the transmitting antenna 718. The computer 712 monitors the signal amplitude from the receiving antenna 718 and a receiver 706 for echoes of the transmitted pulse. In some embodiments, monitoring is executed by magnetic resonance signal processing.

While specific embodiments have been shown and described, modifications can be made by one skilled in the art without departing from the spirit or teaching of this disclosure. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of treating a subterranean formation including:

providing a fracturing fluid containing a magnetically permeable material including an explosive material;

injecting the magnetically permeable fracturing fluid into the formation;

fracturing the formation with the fracturing fluid;

sending electromagnetic radiation into the formation from a borehole;

heating the magnetically permeable material in response to the electromagnetic radiation; and exploding the explosive material in response to the heating.

2. The method of claim 1 further comprising tracking the acoustic emissions of the electromagnetically heated and exploded material.

3. The method of claim 1, wherein the explosive material is disposed in a cavity formed in the magnetically permeable material.

4. The method of claim 1, wherein the explosive material is to detonate at a predetermined temperature, pressure, or temperature and pressure.

5. The method of claim 1, further comprising fracturing the formation via acoustic emissions produced by the exploding.

6. The method of claim 1, further comprising heating the formation and formation fluids responsive to the heating of the magnetically permeable material.

7. The method of claim 1, wherein the magnetically permeable material is at least one of a magnetically permeable ball and a magnetized ball.

8. The method of claim 1, further comprising monitoring a return electromagnetic signal from the electromagnetic radiation.

9. The method of claim 1, further comprising generating an electromagnetic pulse, and monitoring a return electromagnetic signal from the electromagnetic pulse.

10. The method of claim 1, further comprising propagating a surface electromagnetic wave along a fracture in the formation to track the progress of the fracture in the formation.

11. A system for treating a subterranean formation, comprising:

a fluid treatment apparatus that injects a fracturing fluid containing a magnetically permeable material including an explosive material into the formation; and an electromagnetic wave generator that sends electromagnetic radiation into the formation from a borehole to heat the magnetically permeable material, and to explode the explosive material via the heat.

12. The system of claim 11, further comprising a sensor that tracks the acoustic emissions of the electromagnetically heated and exploded material.

13. The method of claim 11, wherein the explosive material is to detonate at a predetermined temperature, pressure, or temperature and pressure.

14. The system of claim 11, wherein acoustic emissions produced by the explosive material are to fracture the formation.

15. The system of claim 11, wherein heat produced by the magnetically permeable material heats the formation and formation fluids.

16. The system of claim 11, wherein the magnetically permeable material is at least one of a magnetically permeable ball and a magnetized ball.

17. The system of claim 11, further comprising a receiver that monitors a return electromagnetic signal from the electromagnetic radiation.

18. The system of claim 11, wherein the electromagnetic wave generator propagates a surface electromagnetic wave along a fracture in the formation to track the progress of the fracture in the formation.

19. The system of claim 11, further comprising a lock-in amplifier coupled to the wave generator, a receiver coupled to the lock-in amplifier, and a computer control coupled to the lock-in amplifier.

20. The system of claim 11, further comprising a switch coupled between the wave generator and a transmitter, an antenna coupled between the transmitter and a receiver, and a switch coupled between the receiver and a computer.

21. The system of claim 11, wherein the electromagnetic radiation induces heating of the magnetically permeable material via hysteretic cycling or viscous drag.

* * * * *

UNITED STATES PATENT AND TRADEMARK OFFICE

CERTIFICATE OF CORRECTION

PATENT NO. : 8,689,875 B2
APPLICATION NO. : 12/990512
DATED : April 8, 2014
INVENTOR(S) : Dudley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 237 days.

Signed and Sealed this
Twenty-ninth Day of September, 2015

Michelle K. Lee

Michelle K. Lee
*Director of the United States Patent and Trademark Office*